United States Patent [19]

Johnson

[11] Patent Number: 4,545,391

[45] Date of Patent: Oct. 8, 1985

[54] CIGARETTE FILTER

[75] Inventor: Robert R. Johnson, Louisville, Ky.

[73] Assignee: Brown & Williamson Tobacco Corporation, Louisville, Ky.

[21] Appl. No.: 497,970

[22] Filed: May 26, 1983

[51] Int. Cl.[4] ..... A24D 3/04

[52] U.S. Cl. ..... 131/336; 131/339; 131/340; 131/361

[58] Field of Search ..... 131/336, 339, 340

[56] References Cited

U.S. PATENT DOCUMENTS 3,059,649 10/1962 Bernhard ..... 131/340

3,860,011 1/1975 Norman ..... 131/340

*Primary Examiner*—V. Millin

*Attorney, Agent, or Firm*—Charles G. Lamb

[57] ABSTRACT

A filter for a cigarette includes a smoke impermeable core of generally cylindrical shape and a smoke permeable material overlaying at least a portion of the periphery of the core. The core with the overlaying permeable material is circumscribed by an air pervious tipping material to form a cigarette filter.

7 Claims, 2 Drawing Figures

CIGARETTE FILTER

BACKGROUND OF THE INVENTION (1) Field of the Invention

This invention relates to filters for cigarettes. In one respect, it relates to a low efficiency filter having a reduced flow path for ventilating air and smoke providing an increased pressure drop to increase the draw resistance of the filter. In another respect, the present invention relates to a filter which functions to direct the flow of smoke exiting the filter from the periphery at the mouth end of the filter.

(2) Description of the Prior Art

It is well known in the art of filter cigarettes to provide filters with ventilation means to allow ambient air to dilute the smoke traveling through the filter. The dilution of the smoke reduces the quantity of smoke particulate as well as the gas phase components which enter the smoker's mouth. For example, the outer wrapper surrounding the tobacco column can be made of a porous material which allows ventilating air to be introduced into the tobacco column along the entire length of the cigarette wherein it mixes with the smoke stream to dilute it before entering the smoker's mouth. Or, the cigarette wrapper may be perforated at selected locations along the length of the cigarette to provide ports through which ventilating air enters the cigarette. It is also known to perforate the wrapper of the filter at the filter end of the cigarette to allow ventilating air to enter the filter and dilute the smoke stream flowing through the filter. Additional suggestions have included forming grooves within the filter plug of a cigarette to facilitate the addition of ventilating air into the smoke stream. Specific examples are shown in U.S. Pat. No. 3,596,663; U.S. Pat. No. 3,577,995; U.S. Pat. No. 3,572,347; U.S. Pat. No. 3,490,461; U.S. Pat. No. 1,718,122; U.S. Pat. No. 3,788,330; U.S. Pat. No. 3,773,053; U.S. Pat. No. 3,752,165; U.S. Pat. No. 3,638,661; U.S. Pat. No. 3,608,561; and U.S. Pat. No. 3,910,288.

Further, in most commercially available cigarettes, either of the ventilated or non-ventilated type, the smoke is concentrated at the center of the mouth end of the filter as it exits the filter into the smoker's mouth thereby missing many of the "taste buds". Therefore, these cigarettes, particularly of the highly ventilated type, deliver very little taste.

It is also true in many ventilated filter cigarettes that the draw effect is substantially less than that of more conventional cigarettes which diminish the smoking pleasure.

SUMMARY OF THE INVENTION

The present invention advantageously provides a straightforward arrangement of a low efficiency cigarette filter which achieves a pressure drop producing a draw effort of a more conventional or normal cigarette. The present invention further provides a ventilated filter for a cigarette for lowering tar predominantly by ventilation. The present invention even further provides a cigarette filter for dispensing the flow of smoke exiting the mouth end of the filter peripherally of the mouth end of the filter instead of centrally of the filter to enhance the flavor to the smoker.

More aprticularly, in one advantageous embodiment, the present invention provides a filter for a cigarette comprising a substantially smoke impermeable core member of substantially cylindrical configuration; a sleeve of smoke permeable material circumscribing the periphery of the cylindrical member; and tipping material extending longitudinally of and circumscribing the sleeve, the tipping material being pervious to air over at least a portion of its surface.

A further advantageous embodiment of the present invention provides a filter for a cigarette comprising a substantially smoke impermeable core member of substantially cylindrical configuration, smoke permeable material overlaying selected portions of the periphery of the smoke impermeable core member; and, tipping material extending longitudinally of and circumscribing the smoke impermeable core and the smoke permeable material, the tipping material being pervious to air over at least a portion of the smoke permeable material.

BRIEF DESCRIPTION OF THE DRAWINGS

A more complete understanding of the present invention will be had upon reference to the specification and accompanying drawings wherein like numerals refer to like parts throughout and in which.

DESCRIPTION OF THE PREFERRED EMBODIMENTS

Figure 1:
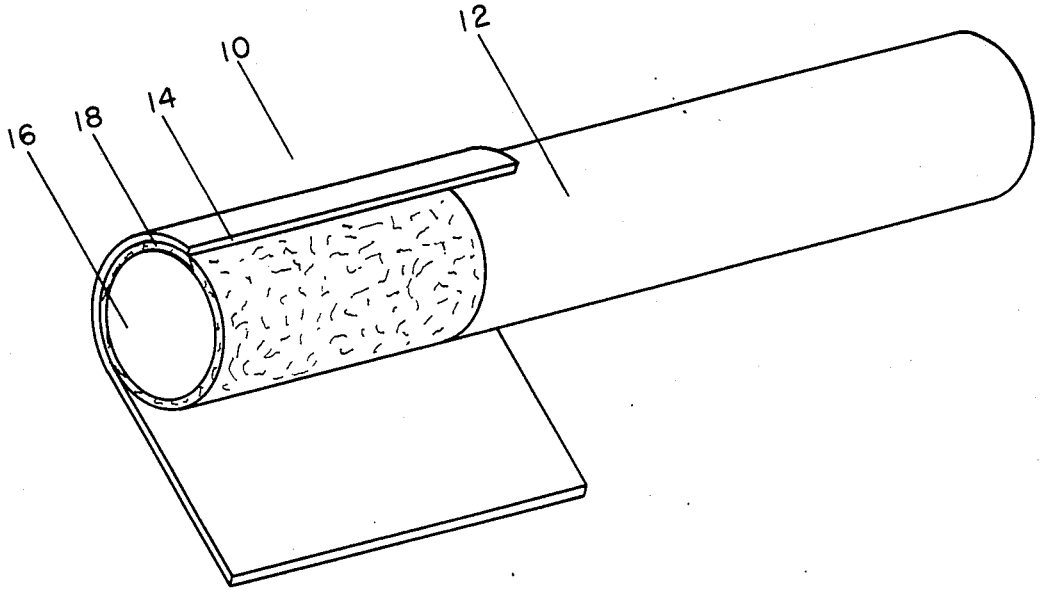
FIG. 1 is a perspective view of a cigarette filter embodying various features of the present invention attached to a tobacco column with the tipping material shown in a partially unwrapped position; and, FIG. 2 is a perspective view of a further cigarette filter construction also embodying the features of the present invention attached to a tobacco column with the tipping material shown in a partially unwrapped position to more clearly show the details of construction.

FIG. 1 illustrates a filter 10 attached to a tobacco column 12 by a tipping paper or material 14. The filter 10 comprises a substantially smoke impermeable core member 16 of substantially cylindrical configuration fabricated of, for example, a closed-cell foamed material such as, a foamed cellulose acetate or polyurethane. A sleeve of smoke permeable member 18 circumscribes the periphery of the core member 16. The sleeve 18 is fabricated of a smoke filtering material and can be advantageously formed of, for example, a cellulose acetate fibrous material or an open-cell foamed cellulose acetate. It is contemplated that, from a manufacturing standpoint, a sleeve 18 fabricated of opened-cell foam would be desirable for the reason that the sleeve and cylindrical core member 16 could be manufactured in one operation by co-extrusion. The tipping material 14 extends longitudinally of and circumscribes the sleeve 18. The tipping material 14 is pervious to ambient air so that, as a smoker draws on the cigarette, ambient ventilating air will be drawn through the tipping material into the interstice of the sleeve 18 to mix with the smoke flowing therein from the tobacco column 12 thereby diluting the smoke stream before it reaches the smoker's mouth. The tipping material 14 can be made pervious to the ambient air by virtually any method such as, for example, fabricating it of a non-porous substance and forming perforations therethrough at preselected intervals, or as illustrated in FIG. 1, the tipping material as can be fabricated of a porous substance.

The smoke impermeable core member 16 and smoke permeable sleeve 18 can be sized, relative to each other, so as to produce different draw resistances. For example, with a filter 10 of a given diameter, for example 8 mm, as the transverse cross-sectional area of the smoke impermeable core member 16 is increased, the cross-sectional flow-through area of the smoke permeable sleeve 18 will be decreased with a corresponding increase in filter draw resistance. The draw resistance of the filter 10 can also be changed by changing the density of the smoke permeable sleeve 18. The various components of the filter 10 are preferably sized and constructed to provide a pressure drop and, therefore, a draw resistance substantially the same as more conventionally constructed cigarette filters.

Another method contemplated for manufacturing the filter 10 is to inject the closed-cell foamed material forming the core member 16 into the area of the central axis of a smoke permeable filter rod. In this instance, the closed-cell foam material will constitute the smoke impermeable core member 16 and the portion of the smoke permeable filter rod surrounding the closed-cell foamed material will constitute the smoke permeable sleeve 18. A further contemplated method of manufacturing the filter 10 is to apply, by spraying or brushing, the closed-cell foamed material onto a tow or web of smoke permeable filter material, and folding or rolling the filter material around the closed-cell foamed material to form the filter.

Figure 2:
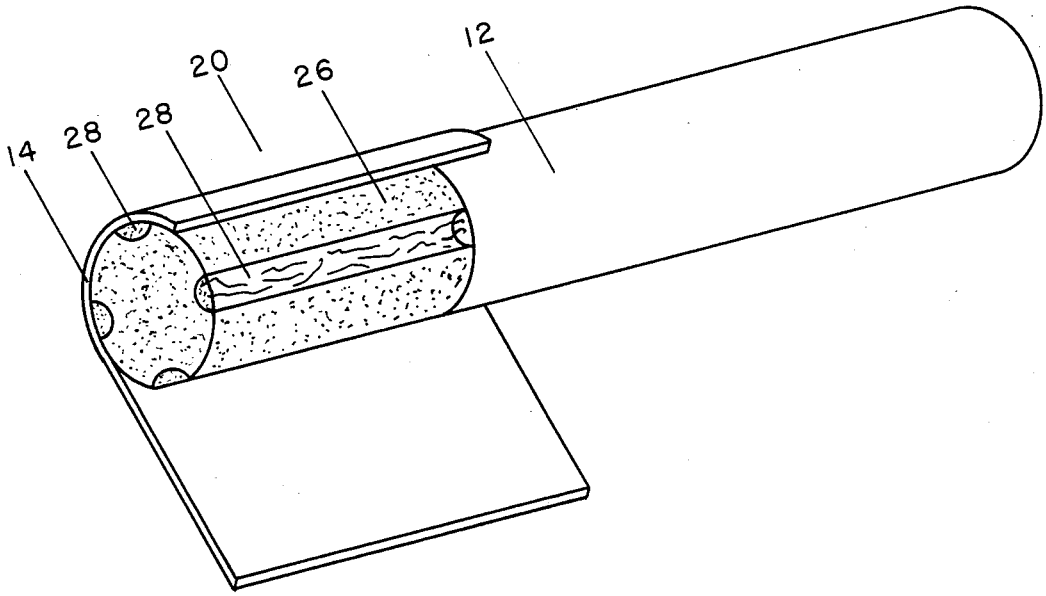

In FIG. 2 there is illustrated a filter 10 attached to the tobacco column 12 by the tipping paper or material 14. The filter 110 comprises a substantially smoke impermeable core member 116 of substantially cylindrical configuration. The coremember 116 can be fabricated of, for example, a closed-cell foamed cellulose acetate or polyurethane. Smoke permeable material in the form of strips 118 overlay selected portions of the periphery of the impermeable core 116. As shown, a plurality of smoke permeable strips 118 are embedded in the periphery of the cylindrical core member 116. The smoke permeable strips 118 extend generally longitudinally of the core member 116 along its entire length, and are equally spaced from each other about the circumference of the core member 116. The smoke permeable strips 118 are fabricated of a smoke filtering material and can be advantageously formed of, for example, a cellulose acetate fibrous material or an open-cell foamed cellulose material. The air pervious tipping material 14 extends longitudinally of and circumscribes the core member 116 and embedded strips 118. As with the filter 10 of FIG. 1, the draw resistance of the filter 20 of FIG. 2 can be adjusted by increasing or decreasing the flow-through cross-sectional areas of the strips 118, by changing the number of strips 118, and by fabricating the strips of material of greater or lesser density.

The smoke steam passing through the smoke permeable sleeve 18 in the embodiment of FIG. 1 and through the smoke permeable strips 118 in the embodiment of FIG. 2 is diluted with ventilating air before it exits the filter into the smoker's mouth. The diluted smoke stream exits the filter peripherally of the cigarette in proximity to the smoker's "taste buds", instead of in a concentration at the center of the mouth end of the filter, which enhances the perceived taste. Furthermore, when appropriately sized and constructed, the filter of the present invention provides a pressure drop which produces a draw resistance substantially the same as a more conventional cigarette.

The foregoing detailed description is given primarly for clearness of understanding and no unnecessary limitations are to be understood therefrom for modifications will become obvious to those skilled in the art upon reading this disclosure and may be made without departing from the spirit of the invention or scope of the appended claims.

The invention claimed is:

1. A filter for a cigarette comprising:

a substantially smoke impermeable core member of generally cylindrical configuration;

strips of smoke permeable material overlaying selected portions of the periphery of said impermeable core member extending generally longitudinally of said core member; and, tipping material extending longitudinally of and circumscribing said smoke impermeable core and said smoke permeable material, said tipping material being pervious to air over at least a portion of said smoke permeable material.

2. The filter of claim 1, wherein said smoke permeable strips are embedded in the periphery of said smoke impermeable core.

3. The filter of claim 2, wherein said strips are generally equally spaced apart from one another about the perimeter of said core.

4. The filter of claim 1, wherein said core is fabricated of a closed-cell foamed material.

5. The filter of claim 1, wherein said permeable material is an open-cell foamed material.

6. A method of making a filter rod for a cigarette comprising the steps of:

forming a generally cylindrically shaped core member of substantially smoke permeable material;

injecting a smoke impermeable foamable material into the area of the central axis of the core member leaving an area surrounding the central axis of the core member substantially free of impermeable material; and, allowing the smoke impermeable foamable material to foam in situ.

7. A method of making a filter rod for a cigarette comprising the steps of;

forming a web of substantially smoke permeable material;

applying a smoke impermeable foamable material to one surface of the web;

folding the web around the smoke impermeable foamable material; and allowing the smoke impermeable material to foam insitu.

* * * * *